US010006228B2

(12) United States Patent
Kim

(10) Patent No.: US 10,006,228 B2
(45) Date of Patent: Jun. 26, 2018

(54) DOOR LATCH DEVICE FOR VEHICLE

(71) Applicant: Hyundai Motor Company, Seoul (KR)

(72) Inventor: Hyong Don Kim, Incheon (KR)

(73) Assignee: Hyundai Motor Company, Seoul (KR)

( * ) Notice: Subject to any disclaimer, the term of this patent is extended or adjusted under 35 U.S.C. 154(b) by 816 days.

(21) Appl. No.: 14/552,330

(22) Filed: Nov. 24, 2014

(65) Prior Publication Data

US 2016/0060908 A1 Mar. 3, 2016

(30) Foreign Application Priority Data

Aug. 28, 2014 (KR) ..... 10-2014-0113405

(51) Int. Cl.
*E05B 79/16* (2014.01)
*E05B 79/20* (2014.01)
*E05B 77/04* (2014.01)

(52) U.S. Cl.
CPC ..... *E05B 79/20* (2013.01); *E05B 77/04* (2013.01)

(58) Field of Classification Search
CPC ..... E05B 79/16; E05B 79/20; E05B 77/04
See application file for complete search history.

(56) References Cited

U.S. PATENT DOCUMENTS 7,703,310 B2 * 4/2010 Usuzaki ..... E05B 17/041 292/125

FOREIGN PATENT DOCUMENTS

KR 10-2013-0139507 A 12/2013

* cited by examiner

*Primary Examiner* — Matthieu F Setliff
*Assistant Examiner* — Thomas L Neubauer
(74) *Attorney, Agent, or Firm* — Morgan, Lewis & Bockius LLP

(57) ABSTRACT

A door latch device for a vehicle may include an inter lever locking or unlocking a door opening and closing a vehicle interior, a cable connected to a door handle disposed on the door; a cable cover surrounding the cable and removably fixed to the cable when the door is shocked; and an open preventing lever configured to be removably fixed to the cable cover, be rotatable when being removed from the cable cover, and have the inter lever which is present within a rotation radius thereof.

5 Claims, 7 Drawing Sheets

DOOR LATCH DEVICE FOR VEHICLE

CROSS-REFERENCE TO RELATED APPLICATION

The present application claims priority to Korean Patent Application No. 10-2014-0113405, filed on Aug. 28, 2014, the entire contents of which is incorporated herein for all purposes by this reference.

BACKGROUND OF THE INVENTION

Field of the Invention

The present disclosure relates to a door latch device for a vehicle, and more particularly, to a door latch device for a vehicle capable of preventing a dangerous situation in which a vehicle door is opened in an abnormal situation such as a broadside collision of the vehicle, or the like.

Description of Related Art

A door for a vehicle (hereinafter, a term to a door latch device for a door for a vehicle) may refer to a door that a passenger of the vehicle such as a car opens or closes to get on or off the vehicle.

However, except for a normal situation in which the passenger of the vehicle pulls a door handle with hand and opens the door to get on or off the vehicle, an opening of the door in a vehicle collision situation, and the like may be very dangerous for the passenger of the vehicle. The passenger of the vehicle may be thrown out of the vehicle through the opened door, and as a result, a serious human-accident may be caused.

Therefore, there is a need for a device capable of preventing the door from being opened in the abnormal situation such as the vehicle collision, or the like.

According to the related art, a door open preventing device which is operated by inertial force in one direction was present, as described in the following Patent Document. However, in a collision situation, or the like in which the above-mentioned special inertial force is not acted, the door open preventing device may not be operated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a door latch device for a vehicle capable of preventing a dangerous situation in which a door for a vehicle is opened in an abnormal situation such as a broadside collision of the vehicle, or the like.

According to an exemplary embodiment of the present disclosure, a door latch device for a vehicle may include an inter lever configured to lock or unlock a door opening and closing a vehicle interior, a cable configured to be connected to a door handle disposed on the door, a cable cover configured to surround the cable and be removably fixed when the door is shocked, and an open preventing lever configured to be removably fixed to the cable cover, be rotatable when being removed from the cable cover, and may have the inter lever which is present within a rotation radius thereof.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
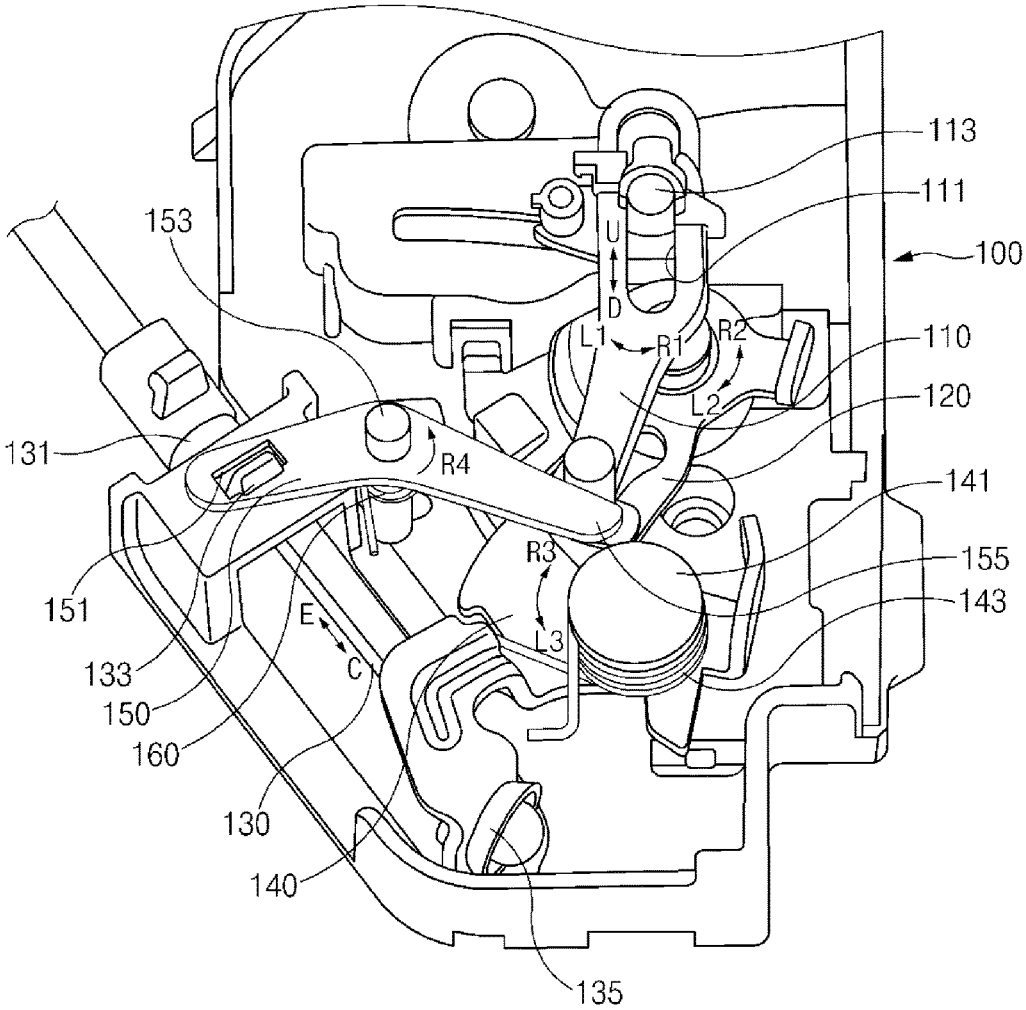
FIG. 1 is a perspective view showing a door latch device for a vehicle according to an exemplary embodiment of the present disclosure.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, exemplary embodiments of the present disclosure will be described in detail with reference to the accompanying drawings. However, the present disclosure will not be limited or restricted to the exemplary embodiments below.

FIG. 1 is a perspective view showing a door latch device for a vehicle according to an exemplary embodiment of the present disclosure.

Hereinafter, a door latch device for a vehicle according to an exemplary embodiment of the present disclosure will be described with reference to FIG. 1.

The door latch device for the vehicle according to the exemplary embodiment of the present disclosure may include an inter lever 110, a cable 130, a cable cover 131, an out lever 140, and an open preventing lever 150.

The inter lever 110 may be a lever locking or unlocking a door for a vehicle 100 (hereinafter, a term r locking or e same meaning) capable of opening and closing a vehicle interior of the vehicle (a space in which a passenger boards). Here, "lock" means that the door 100 is in a locked state, and "unlock" means that the door 100 is in an opened state.

The inter lever 110 may perform rotary motion in an R1 or L1 direction based on a second shaft 113. In addition, the inter lever 110 may be linearly moved in a U direction or D direction while being coupled to the second shaft 113.

The inter lever 110 includes a guide hole 111. The inter lever 110 may be coupled to the second shaft 113 which is a shaft of the inter lever 110 through the guide hole 111 so as to be linearly moved. Therefore, the inter lever 110 may perform both the rotary motion in the R1 or L1 direction and the linear motion in the U or D direction.

A state in which the inter lever 110 is moved in the L1 direction is the lock mode in which the door 100 is locked, and a state in which the inter lever 110 is moved in the R1 direction is the unlock mode in which the door 100 is opened.

FIG. 1 shows a state in which the inter lever is in the lock mode. If the inter lever 110 moves to the R1 direction in this state, the inter lever 110 moves a pawl lever 120 in an R2 direction and the door 100 may be opened by a rotation of the pawl lever 120.

Although the present exemplary embodiment shows a configuration in which the door 100 is opened by the pawl lever 120, the present invention may also be designed by a configuration in which the inter lever 110 directly opens the door 100. Since this configuration is apparent to those skilled in the art, an additional description thereof will be omitted.

The cable 130 may be connected to a door handle disposed on the door 100. The door handle may be connected to an end portion in an E direction from the cable 130. The door handle may refer to a portion that the passenger of the vehicle grasps with hand to open the door 100. As the passenger pulls the door handle with hand, the cable 130 may be linearly moved in the E direction.

The cable cover 131 may have a configuration surrounding the cable 130. The cable cover 131 may be removably fixed to the door 100 when the door 100 is shocked from the outside or collides with an external object.

The out lever 140 may be rotated based on a third shaft 141. The out lever 140 may be disposed so as to be rotated by receiving rotational force from the cable 130. The out lever 140 and the cable 130 may be connected to each other by a connecting part 135. When the cable 130 moves in the E direction, the out lever 140 may be rotated in an R3 direction. The out lever 140 which is rotationally moved in the R3 direction may be rotationally moved in an L3 direction by a restoring spring 143 and may be returned to an original position.

A process in which the door is opened in a normal operation state will be described as follows. If the passenger pulls the door handle with hand and moves the cable 130 in the E direction, the out lever 140 is rotationally moved in the R3 direction by receiving the rotational force from the cable 130. The out lever 140 transfers power to the inter lever 110 which is positioned within a rotation radius of the out lever 140 while being rotated in the R3 direction, thereby rotating the inter lever 110 in the R1 direction. The inter lever 110 rotated in the R1 direction rotationally moves the pawl lever 120 in the R2 direction, thereby opening the door 100 (an unlock mode).

Meanwhile, the open preventing lever 150 may be a lever for preventing the door 100 from being abnormally opened when the door 100 is in a shock or collision situation.

The open preventing lever 150 may be removably fixed to the cable cover 131. When the open preventing lever 150 is coupled to the cable cover 131, it may be fixed to the cable cover 131 without being rotated.

The open preventing lever 150 has a catching groove 151 formed in one side based on a first shaft 153 which is a shaft of the open preventing lever 150, wherein the catching groove 151 may be coupled to a catching protrusion 133 which protrudes from the cable cover 131. By coupling the catching protrusion 133 to the catching groove 151, the open preventing lever 150 may be fixed to the cable cover 131.

However, the open preventing lever 150 is not always fixed. The open preventing lever 150 may be separated and removed from the cable cover 131, and when being removed, the open preventing lever 150 may be rotationally moved based on the first shaft 153. In this case, the open preventing lever 150 may be rotationally moved by elastic force received from an elastic body 160 coupled to the first shaft 153. In addition, the inter lever 110 may be present within the rotation radius of the open preventing lever 150 which is rotationally moved as described above.

When the cable cover 131 is damaged or deviated in a situation such as a vehicle collision, or the like, the open preventing lever 150 may be removed from the cable cover 131. The open preventing lever 150 removed from the cable cover 131 may be rotationally moved in an R4 direction. The open preventing lever 150 which is rotationally moved in the R4 direction may move the inter lever 110 which is positioned within the rotation radius thereof in the U direction. Consequently, the inter lever 110 may get out of the rotation radius of the out lever 140. As a result, despite the rotation of the out lever 140, the inter lever 110 may not be moved from the lock mode to the unlock mode.

According to the above-mentioned scheme, the door latch device for the vehicle according to the exemplary embodiment of the present disclosure may prevent a dangerous situation in which the door for the vehicle is opened in the abnormal situation such as the broadside collision of the vehicle, or the like.

Hereinafter, an operation state of the door latch device for the vehicle according to the exemplary embodiment of the present disclosure will be described.

Normal Operation State

Figure 2:
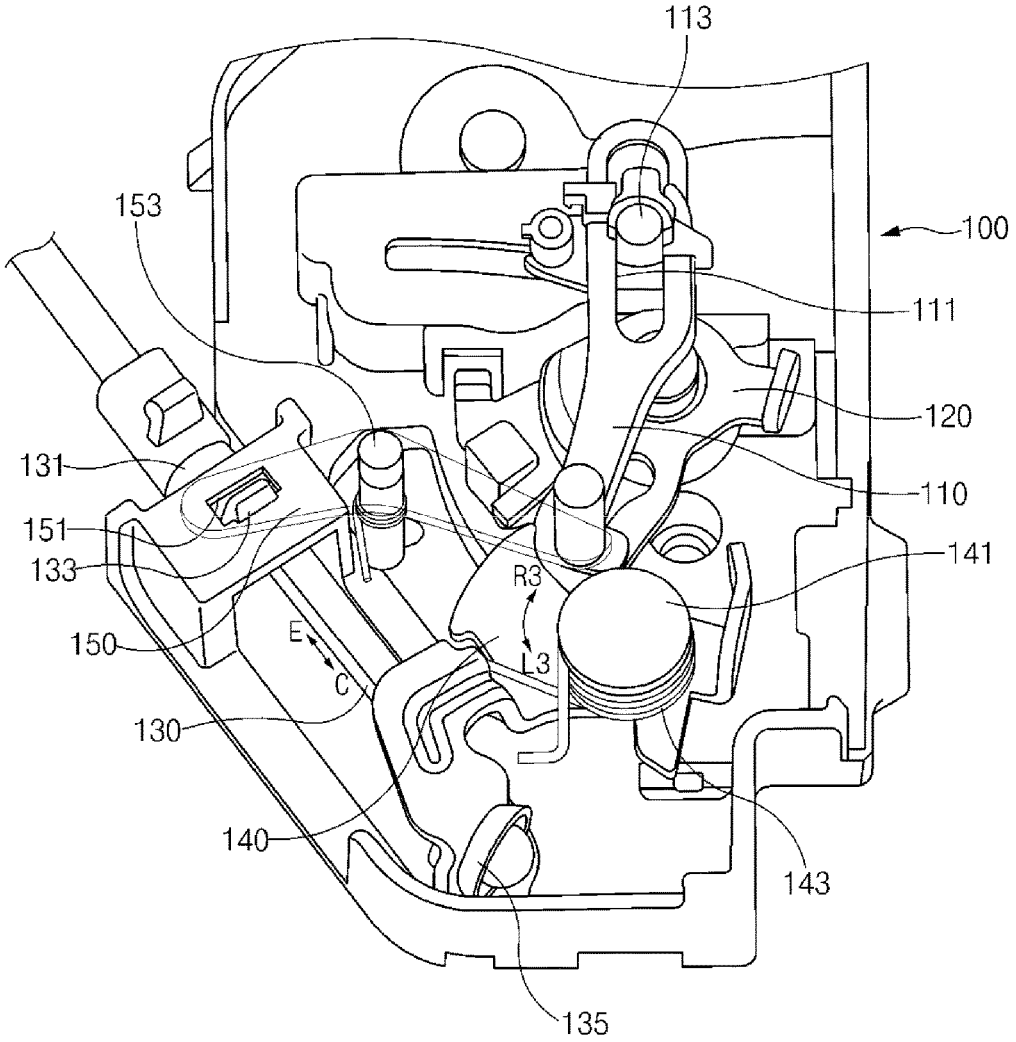
FIG. 2 is a perspective view showing a form in which the door latch device for the vehicle according to the exemplary embodiment of the present disclosure is in a lock mode in a normal operation state.
Figure 3:
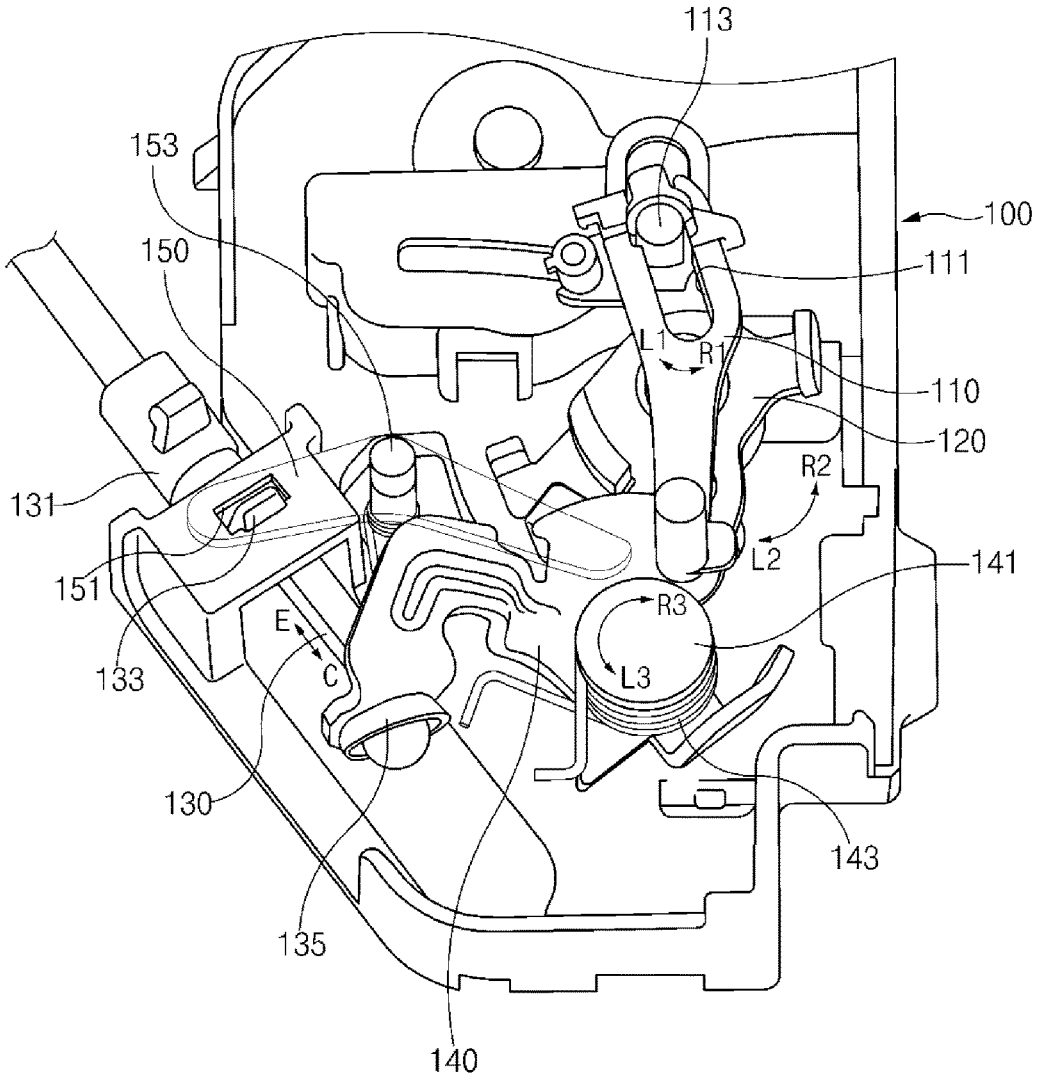
FIG. 3 is a perspective view showing a form in which the door latch device for the vehicle according to the exemplary embodiment of the present disclosure is in an unlock mode in the normal operation state.
Figure 4:
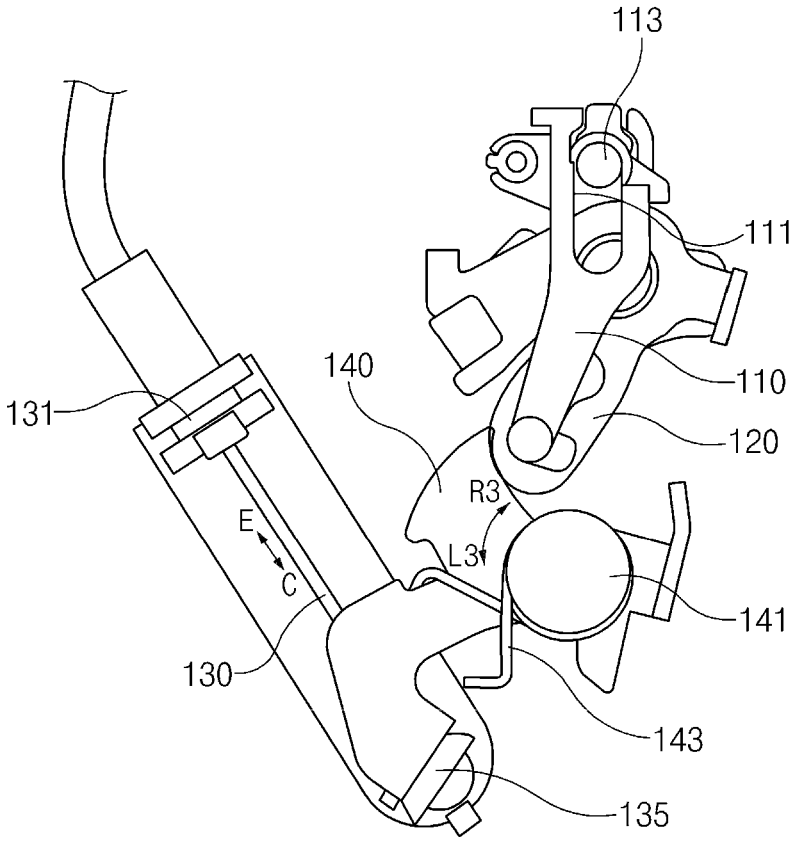
FIG. 4 is a front view showing a position of an out lever in the lock mode of FIG. 2.
Figure 5:
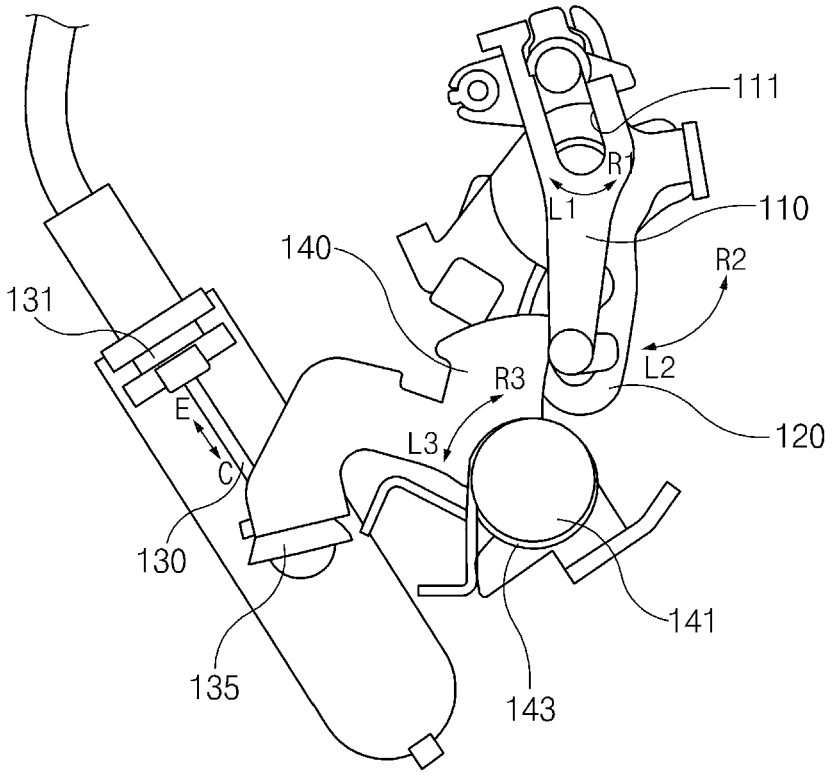
FIG. 5 is a front view showing a position of an out lever in the unlock mode of FIG. 3.

FIG. 2 is a perspective view showing a form in which the door latch device for the vehicle according to the exemplary embodiment of the present disclosure is in a lock mode in a normal operation state. FIG. 3 is a perspective view showing a form in which the door latch device for the vehicle according to the exemplary embodiment of the present disclosure is in an unlock mode in the normal operation state. FIG. 4 is a front view showing a position of an out lever in the lock mode of FIG. 2. FIG. 5 is a front view showing a position of an out lever in the unlock mode of FIG. 3.

Referring to FIGS. 2 and 3, FIGS. 2 and 3 show the case in which the door latch device for the vehicle is in a normal operation state. FIG. 2 shows a lock mode state and FIG. 3 shows an unlock mode state. That is, FIG. 2 shows a state in which the door is locked, and the FIG. 3 shows a state in which the door is opened.

Referring to FIGS. 2 and 4, the cable 130 is in a state in which it is not pulled, and consequently, the out lever 140 and inter lever 110 are positioned in the lock mode.

Referring to FIGS. 3 and 5, as the passenger pulls the door handle, the cable 130 is pulled in the E direction. If the cable 130 is pulled in the E direction, the out lever 140 may be rotated in the R3 direction and the inter lever 110 which is in the rotation radius of the out lever 140 may be moved in the R1 direction.

The inter lever 110 rotated in the R1 direction rotationally moves the pawl lever 120 in the R2 direction, thereby opening the door 100 (an unlock mode).

Operation Upon Vehicle Collision

Figure 6:
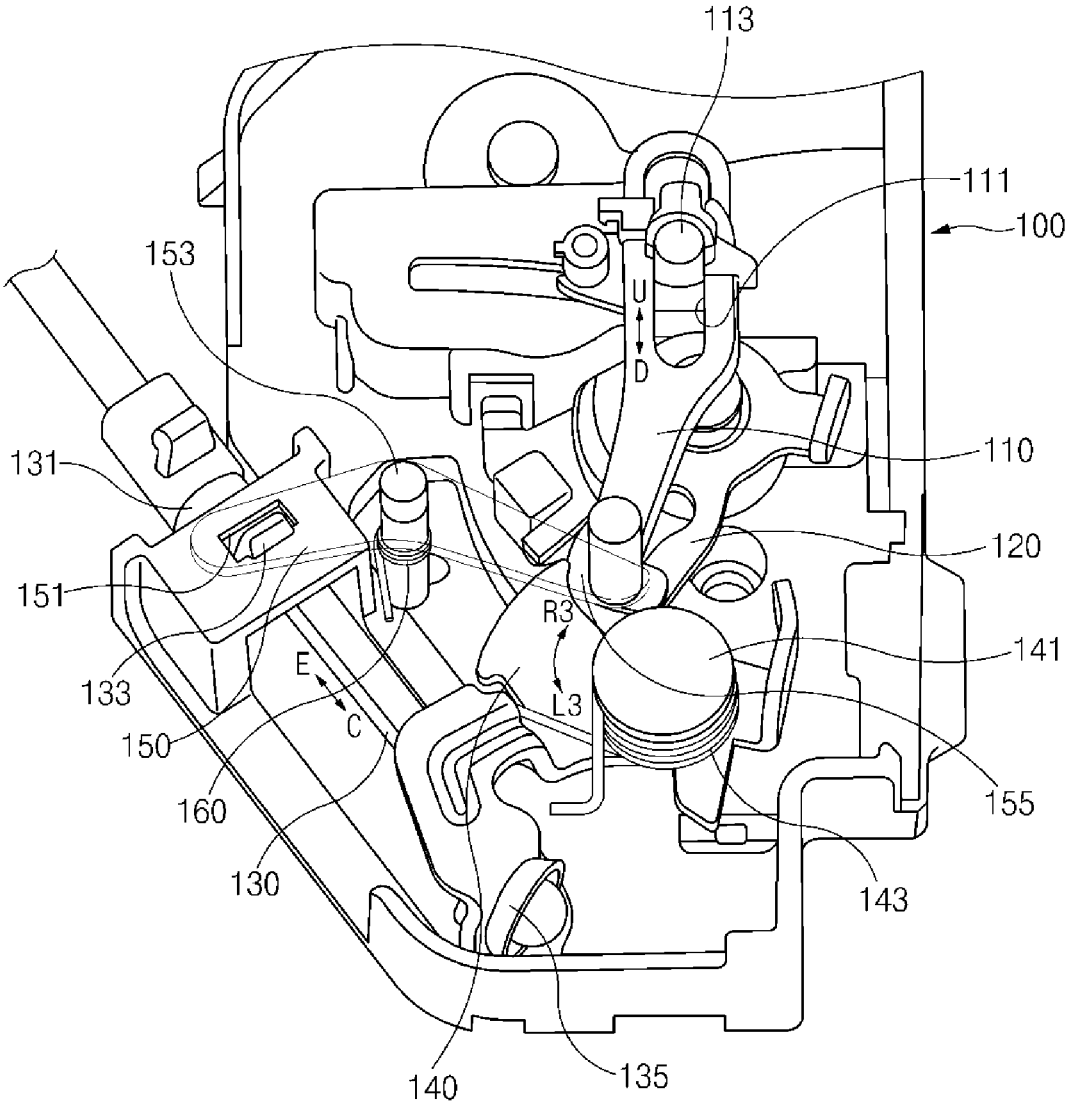
FIG. 6 is a perspective view showing a form in which the door latch device for the vehicle according to the exemplary embodiment of the present disclosure is in the lock mode before a door collision.
Figure 7:
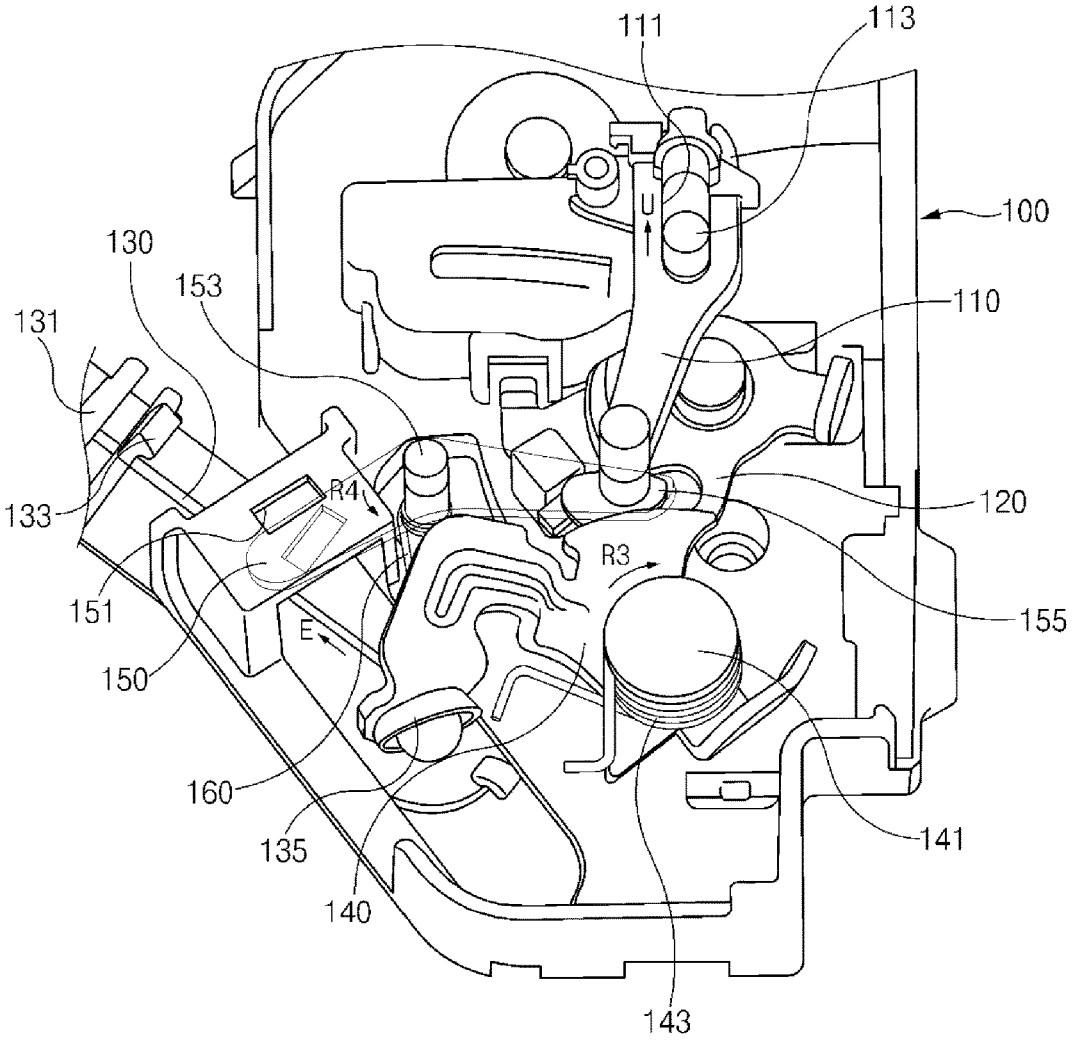
FIG. 7 is a perspective view showing a form in which the door latch device for the vehicle according to the exemplary embodiment of the present disclosure maintains the lock mode after the door collision.

FIG. 6 is a perspective view showing a form in which the door latch device for the vehicle according to the exemplary embodiment of the present disclosure is in the lock mode before a door collision. FIG. 7 is a perspective view showing a form in which the door latch device for the vehicle according to the exemplary embodiment of the present disclosure maintains the lock mode after the door collision.

Referring to FIGS. 6 and 7, if the door 100 is in the shock or collision situation and consequently, an abnormal situation in which the cable cover 131 is damaged or deviated and the cable 130 is pulled in the E direction occurs, the open preventing lever 150 may prevent the door 100 from being abnormally opened.

Referring to FIG. 6, before the collision of the door 100, the open preventing lever 150 is fixed to the cable cover 131. By coupling the catching protrusion 133 to the catching groove 151, the open preventing lever 150 may be fixed to the cable cover 131.

Referring to FIG. 7, if the abnormal situation such as the broadside collision of the vehicle, or the like occurs, the cable cover 131 is damaged or deviated, and consequently, the open preventing lever 150 is separated and removed from the cable cover 131 and is rotationally moved in the R4 direction. In this case, the open preventing lever 150 may be rotationally moved by elastic force received from an elastic body 160 coupled to the first shaft 153. In addition, the inter lever 110 may be present within the rotation radius of the open preventing lever 150 which is rotationally moved.

In this case, as shown in FIGS. 1 and 7, the open preventing lever 150 may include a pressing part 155 which is positioned on the other side based on the first shaft 153. The pressing part 155 may be extended in a direction which is away from the first shaft 153 and may directly press and move the inter lever 110 when the open preventing lever 150 is rotated.

By the above-mentioned configuration, the open preventing lever 150 is rotationally moved in the R4 direction and may move the inter lever 110 in the U direction. In this case, the inter lever 110 may get out of the rotation radius of the out lever 140.

Once the inter lever 110 gets out of the rotation radius of the out lever 140, the inter lever 110 may not be moved from the lock mode to the unlock mode although the out lever 140 is abnormally rotated in the abnormal situation in which the cable cover 131 is damaged or deviated and the cable 130 is pulled in the E direction.

According to the above-mentioned scheme, the door latch device for the vehicle according to the exemplary embodiment of the present disclosure may prevent the dangerous situation in which the door for the vehicle is opened in the abnormal situation such as the broadside collision of the vehicle, or the like, and may prevent very dangerous situation such as a human accident which may occur at the passenger of the vehicle.

As described above, according to the exemplary embodiment of the present disclosure, the door latch device for the vehicle includes the open preventing lever which prevents the open of the door in the abnormal situation in which the cable is pulled while the cable cover is damaged or deviated, thereby making it possible to prevent the dangerous situation in which the door for the vehicle is opened in the abnormal situation such as the broadside collision of the vehicle, or the like.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door latch device for a vehicle, the door latch device comprising:

an inter lever locking or unlocking a door opening and closing a vehicle interior;

a cable connected to a door handle disposed on the door;

a cable cover surrounding the cable and removably provided to the cable when the door is shocked by an external object from the outside or collides with the external object;

an open preventing lever removably provided to the cable cover and rotatable when being removed from the cable cover, wherein the inter lever is positioned within a rotation radius of the open preventing lever; and an out lever rotatably disposed and receiving a rotational force from the cable, wherein the inter lever is selectively present within a rotation radius of the out lever, and is moved by receiving power from the out lever when the inter lever is engaged to the out lever, and wherein when the open preventing lever is removed from the cable cover, the open preventing lever is rotated and moves the inter lever out of the rotation radius of the out lever.

2. The door latch device according to claim 1, wherein the open preventing lever has a catching groove formed in one side based on a shaft of the open preventing lever, and the catching groove is coupled to a catching protrusion which protrudes from the cable cover.

3. The door latch device according to claim 2, wherein the open preventing lever includes a pressing part which is positioned on another side based on the shaft of the open preventing lever, and the pressing part presses and moves the inter lever when the open preventing lever is rotated.

4. The door latch device according to claim 1, further comprising an elastic body transferring rotation force to the open preventing lever.

5. The door latch device according to claim 1, wherein the inter lever includes a guide hole coupled to a shaft and the guide hole of the inter lever is linearly moved along the shaft.

* * * * *